United States Patent [19]

Hellewell

[11] Patent Number: 4,505,435

[45] Date of Patent: Mar. 19, 1985

[54] APPARATUS FOR REMOVAL OF TROUBLESOME MINERAL MATTER FROM PULVERIZED COAL

[75] Inventor: Todd D. Hellewell, Windsor, Conn.

[73] Assignee: Combustion Engineering, Inc., Windsor, Conn.

[21] Appl. No.: 495,012

[22] Filed: May 16, 1983

[51] Int. Cl.[3] ..... B02C 23/32

[52] U.S. Cl. ..... 241/79.1; 110/122; 241/80; 241/119

[58] Field of Search ..... 241/18, 19, 24, 52, 241/53, 57, 79.1, 80, 97, 117–122; 110/222

[56] References Cited

U.S. PATENT DOCUMENTS 4,252,638 2/1981 Bender et al. ..... 241/24 X 4,264,041 4/1981 Kitto, Jr. et al. ..... 241/119 X

FOREIGN PATENT DOCUMENTS 620128 9/1935 Fed. Rep. of Germany ..... 241/121

*Primary Examiner*—Mark Rosenbaum

*Attorney, Agent, or Firm*—Robert L. Olson

[57] ABSTRACT

A system for pulverizing coal to be burned in a furnace (20), where nearly all of the coarse ash particles are removed from the coal prior to its introduction to the furnace. The system includes a pulverizing mill (10) having a first classifier (12) in its outlet for separating some of the large, heavy particles and returning them to the pulverizer. A second classifier (16) is connected to the first classifier, and includes a curved duct (16) wherein the solid particles being carried in an airstream are thrown outwardly against an outer wall. A skimmer blade (78) extending through the outer wall skims off a percentage of the large, heavy particles, the percentage depending on how much coarse ash the coal stream contains. The rest of the coal particles are conveyed to a furnace and burned therein. The separated large, heavy particles are passed through an ionizer (30) and then through an electrostatic separator (34), where the inorganic particles are separated from the coal particles. The coal particles can then be conveyed to the furnace or sent back to the pulverizer for further grinding.

2 Claims, 2 Drawing Figures

APPARATUS FOR REMOVAL OF TROUBLESOME MINERAL MATTER FROM PULVERIZED COAL

BACKGROUND OF THE INVENTION

When burning coal in the furnaces of steam generating units, one of the significant costs, both for original equipment and operation, is for dealing with the ash contained in the coal, particularly if a high ash-bearing coal is involved. In one type of present day coal-fired unit, the coal is pulverized to a flour-like consistency in a pulverizer and then carried in an airstream to the furnace where it is burned. Large pieces of mineral matter, such as tramp iron, which are too heavy to be picked up in the airstream, are discarded from the pulverizer. Also, a classifer located in the outlet from the pulverizing mill is set to separate a percentage (such as 10–20%) of the larger, heavier particles carried in the airstream and return them to the pulverizer for further grinding.

A large portion of the particles returned to the pulverizer for further grinding is ash, which is made up in large part by mineral matter, such as pyrites and quartz. Many of these particles never do get pulverized to a flour-like fineness, and thus they are separated out by the classifier and recirculated back to the pulverizer time after time. This greatly reduces the operating capacity of the pulverizer and also substantially increases the wear of the grinding apparatus, resulting in more frequent maintenance shutdowns. In large steam generating units, which utilize a number of pulverizing mills, the reduced capacity caused by the repeated recirculation of the "heavies" back to the pulverizer may require that an additional one or two mills be installed when the plant is first built, over that which would be required without this large amount of recirculation.

In spite of the fairly effective separation of the mineral matter from the coal in the classifier, some does still get carried over to the furnace. This might only represent a few percent (10% or less) of the entire amount of coal introduced to the furnace, but it contributes in a large sense to the maintenance and operating costs of the steam generator. The steam generator will have reduced generating capacity and availability because of the problems with furnace slag deposits. More soot blowers are required, and more frequent operation thereof is necessary when there is more than a minimal amount of ash in the coal being introduced into the furnace of a steam generator. Also, some of the mineral matter, in the form of pyritic sulfur, contributes to the $SO_2$ problems in the combustion exhaust gases. From the above, it can be seen that if all but a minimal amount of the coarse ash particles could be economically removed from the coal leaving a pulverizing mill flowing to a steam generator, it would be highly desirable.

SUMMARY OF THE INVENTION

In accordance with the invention, a system is provided for economically removing coarse mineral particles (ash) from the coal-airstream flowing from the classifier in the outlet of a pulverizing mill. This is accomplished by subjecting the flow to centrifugal force, and then locating an adjustable skimmer blade or knife such that it skims off a certain percentage (0–15%) of the heavier particles, the percentage skimmed off depending to a large extent on the amount of coarse ash particles the coal originally contained. The separated heavy particles are fed to an ionizer, which declumps the coal/ash particle stream before it enters the separator. The particles are then passed to an electrostatic separator, where the charged organic particles are separated from the noncharged mineral particles. Coal/ash separation can also be achieved by use of magnetic separators. The recovered coal can be returned to the pulverizing mill or fed directly to the furnace, and the mineral particles can be discarded.

DESCRIPTION OF THE PREFERRED EMBODIMENT

Figure 1:
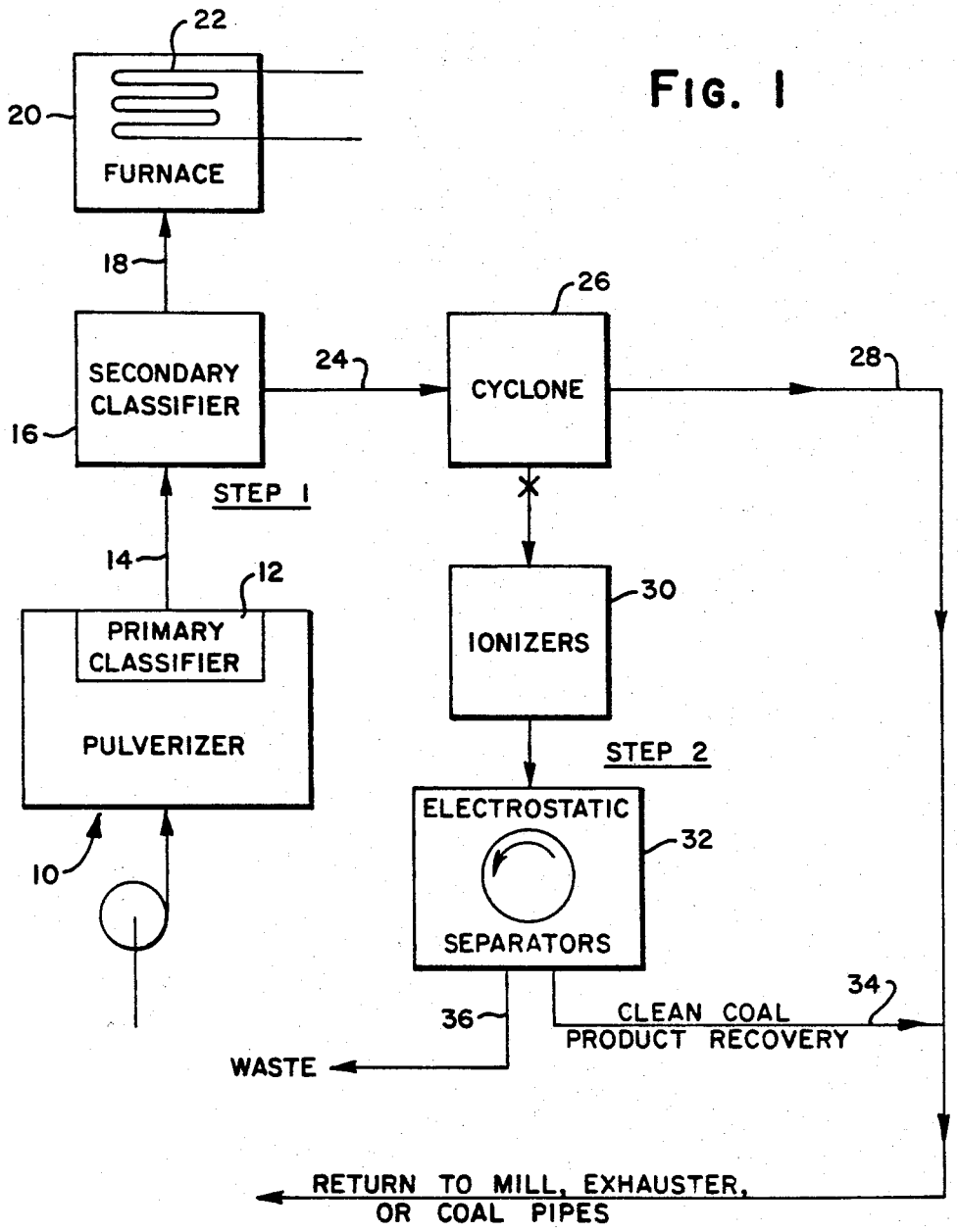
FIG. 1 is a schematic representation of a coal-fired steam generator.

Looking now to FIG. 1 of the drawing, numeral 10 designates a pulverizer in which coal can be ground to a flour-like consistency, so that it can be transported in an airstream to the furnace of a steam generator, there to be burned in suspension. A primary classifier 12 located within the pulverizer housing, separates out the large, heavy particles from the airstream returning them to the pulverizer for further grinding. The classifier can be adjusted so that the size of the particles allowed to leave the classifier in the airstream can be changed if desired. The airstream carrying the fine coal particles flows through duct 14 to the secondary classifier 16. Here again, the larger, heavier particles are separated out and removed from the airstream flowing to the furnace. The remaining coal, now containing only fine ash particles, is carried through duct 18 to the furnace 20 where it is burned. The heat is used to produce steam in the steam generator 22. The construction of the pulverizer and the two classifiers will be described in more detail further on in conjunction with FIG. 2.

The heavy particles separated out in the classifier 16 are conveyed through duct 24 to a cyclone separator 26, which separates the solid particles from the air they were being conveyed in. The air, along with the small amount of very fine particles (400 mesh or smaller), leaves the cyclone through duct 28. The solid particles are gravity discharged into an ionizer 30, where the static charges, causing clumping of the coal and ash particles, are neutralized. The material then passes on to an electrostatic separator 32, where the charged coal particles are separated out and are discharged through line 34. The inorganic, or waste ash products, are disposed of through line 36. The coal in line 34 can be rejoined with the small amount of very fine particles in line 28, and these can then be recirculated back to the pulverizer for further grinding or carried to the furnace 20 for combustion thereof.

Figure 2:
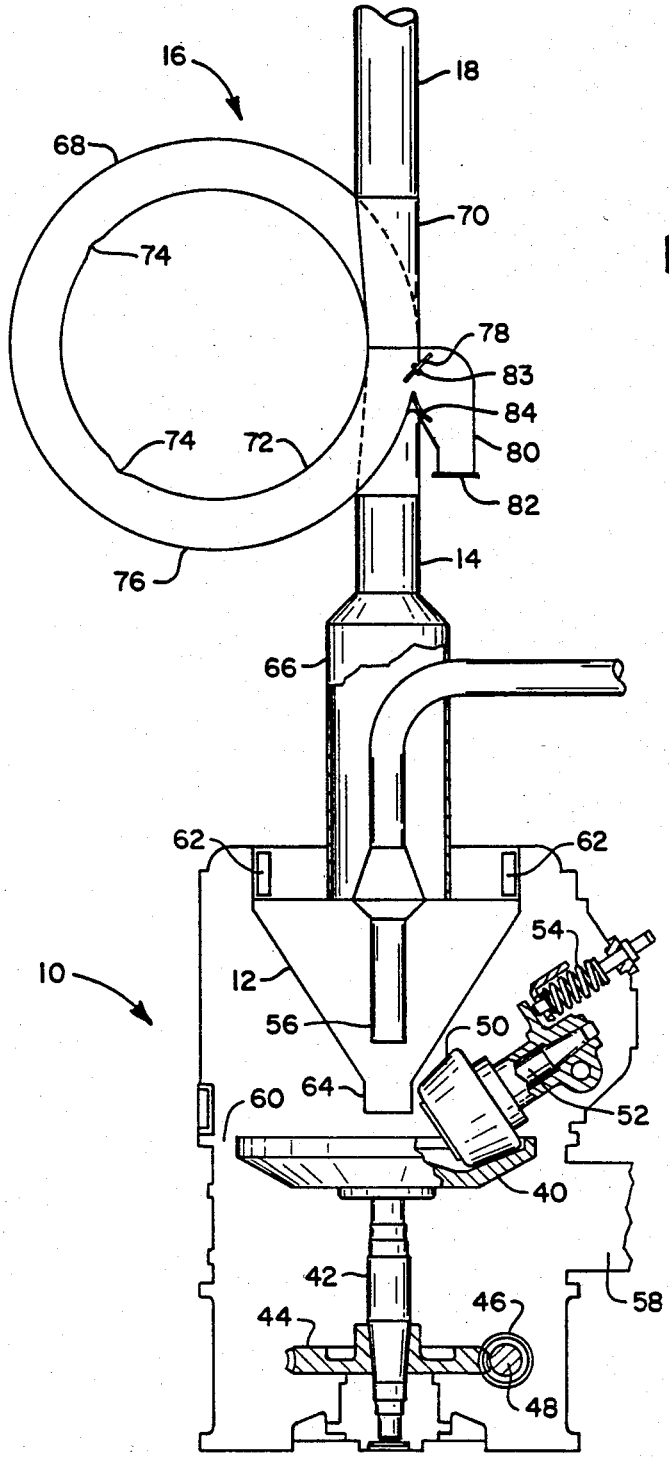
FIG. 2 is a sectional elevation of the pulverizer and primary and secondary classifiers shown in FIG. 1.

Looking now to FIG. 2, the construction of the pulverizer and the two classifiers will be described in more detail. The pulverizer 10 has a rotatable bowl 40 mounted on the shaft 42. Shaft 42 is rotated by means of worm wheel 44, which engages worm 46 mounted on the motor driven shaft 48. A plurality of grinding elements or rollers 50 are rotatably mounted on shafts 52. Adjustable springs 54 urge the rollers 50 towards the inner face of the grinding ring or bowl 40.

Coal to be pulverized is introduced into the mill through pipe 56. Air flows to the mill from a fan (not shown) and enters through opening 58 and flows through the annular space 60, picking up and conveying the ground or pulverized material passing over the lip of the bowl and carrying it upwardly through the mill interior to the primary classifier 12. The air and coal stream enters the classifier 12 by way of adjustable vaned inlets 62, directing the flow tangentially within the classifier so as to cause the coal and air to spin therein. The larger, heavier particles of coal and ash or impurities are separated out of the airstream and fall back onto the grinding ring 40 through bottom opening 64. By adjusting the vanes in inlet openings 62, greater or lesser spin can be given to the material, thus changing the amount of material that will be separated out and fall back onto the grinding bowl. The smaller particles are carried along by the air and are discharged through the upper outlet 66. Outlet 66 is connected to the inlet of the secondary classifier 16 by means of duct 14.

The classifier 16 includes a ring duct 68 which extends 360° around, so that outlet 70, which is connected to duct 18, extends in the same direction as the inlet duct 14. Located along the inner wall 72 of the ring is a plurality of restrictions 74. These not only temporarily restrict the flow, thus increasing the flow velocity, but they also tend to throw the heavier particles outwardly towards the outer wall 76. Thus as the flow approaches the outlet 70, the larger, heavier particles in the airstream are concentrated along the outer wall 76. Located just upstream of the outlet 70 is the skimmer blade 78. This blade 78 is positioned so that its leading edge can be pivoted out into the duct 68, skimming off some of the particles and forcing them to flow into the chamber 80. These particles are discharged through opening 82 into the duct 24, shown in the FIG. 1 schematic. The blade 78 is adjustable or pivotable about axis or rod 83, so that it can be set to skim off more or less of the solid particles and direct them into the chamber 80. If it is desired to operate the system and not skim off any solids from the secondary classifier 16, this can be done by pivoting blade 78 completely out of the duct. Then adjustable shut-off plate 84 can be moved so as to completely close off the opening in the duct wall. As mentioned earlier, approximately 5–15% of the solids are normally skimmed out of the airstream in secondary classifier 16 to insure the removal of almost all of the coarse inorganic ash particles such as pyrites and quartz. This mixture of material is then passed on to the cyclone 26 shown in FIG. 1 for further treatment and separation. The remainder of the particles, being mostly coal with some fine ash, are conveyed through duct 18 to the furnace 20 (FIG. 1) where they are burned.

I claim:

1. In combination a pulverizing mill in which coal is pulverized, a pulverizer outlet through which the pulverized coal is discharged in an air stream, first classifier means connected to the pulverizer outlet for separating some of the heavy large particles out of the air stream, means by which the heavy particles are returned to the pulverizing mill for further pulverizing, second classifier means connected to the first classifier means in which more of the heavy large particles are separated out of the air stream, the second classifier means including a curved duct for imparting centrifugal force to the coal-air stream so that most of the solid particles are thrown outwardly against the outer wall, and a blade extending through an outer wall at an angle to thereby skim off some of the large heavy particles from the air stream, said blade being adjustable so that the distance it extends through the outer wall can be varied, thus varying the amount of heavy large particles separated from the air stream, a furnace, means connecting the second classifier means to the furnace, so that the air stream along with the remaining coal particles can be transferred therein to the furnace, where the coal is combusted, separating means capable of separating organic particles from inorganic particles, and means through which the heavy large particles separated from the air stream in the second classifier means are transferred to the separating means.

2. The combination set forth in claim 1, wherein the separating means includes an ionizer and an electrostatic separator.

* * * * *